US007284607B2

(12) United States Patent
Araque et al.

(10) Patent No.: US 7,284,607 B2
(45) Date of Patent: Oct. 23, 2007

(54) SYSTEM AND TECHNIQUE FOR ORIENTING AND POSITIONING A LATERAL STRING IN A MULTILATERAL SYSTEM

(75) Inventors: Carlos Araque, Sugar Land, TX (US); John R. Whitsitt, Houston, TX (US); Martin Prado, Houston, TX (US); Robert Scott Neves, Houston, TX (US); Christine L. Cano, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 231 days.

(21) Appl. No.: 10/905,329

(22) Filed: Dec. 28, 2004

(65) Prior Publication Data

US 2006/0137874 A1 Jun. 29, 2006

(51) Int. Cl.
*E21B 23/00* (2006.01)
*E21B 43/12* (2006.01)
*E21B 31/14* (2006.01)

(52) U.S. Cl. ..... 166/255.3; 166/313; 166/117.5

(58) Field of Classification Search ..... 166/255.3, 166/313, 117.5, 117.6, 241.6, 50, 382, 378, 166/380

See application file for complete search history.

(56) References Cited

U.S. PATENT DOCUMENTS 5,458,209 A 10/1995 Hayes et al.
5,477,925 A * 12/1995 Trahan et al. ..... 166/382
5,875,847 A * 3/1999 Forsyth ..... 166/313
5,944,108 A 8/1999 Baugh et al.
5,996,711 A 12/1999 Ohmer
6,012,526 A 1/2000 Jennings et al.
6,065,543 A * 5/2000 Gano et al. ..... 166/378
6,186,233 B1 2/2001 Brunet
6,209,644 B1 4/2001 Brunet
6,209,648 B1 * 4/2001 Ohmer et al. ..... 166/313
6,401,812 B2 6/2002 Leising
6,419,014 B1 7/2002 Meek et al.
6,479,415 B1 11/2002 Erspamer et al.
6,510,898 B1 1/2003 Buytaert
6,561,279 B2 5/2003 MacKenzie et al.
6,591,905 B2 7/2003 Coon
6,619,400 B2 * 9/2003 Brunet ..... 166/313
6,752,211 B2 6/2004 Dewey et al.
7,240,738 B2 * 7/2007 Pendleton ..... 166/382
2006/0027359 A1 2/2006 Carter et al.

FOREIGN PATENT DOCUMENTS

WO WO 02/48504 6/2002

* cited by examiner

*Primary Examiner*—Kenneth Thompson
*Assistant Examiner*—David Andrews
(74) *Attorney, Agent, or Firm*—Bryan L. White; Kevin P. McEnaney; Dale V. Gaudier

(57) ABSTRACT

A technique that is usable with a subterranean well that has a first string that lines a borehole includes running a second string into the well and engaging a deflecting face of a deflector to deflect the second string into a window of the first string. The technique includes performing at least one of positioning the second string and orienting the second string using a profile on the deflector downhole of the deflecting face.

35 Claims, 5 Drawing Sheets

SYSTEM AND TECHNIQUE FOR ORIENTING AND POSITIONING A LATERAL STRING IN A MULTILATERAL SYSTEM

BACKGROUND

The invention generally relates to a system and technique for orienting and positioning a lateral string in a multi-lateral system.

A multi-lateral well includes a parent wellbore and one or more lateral wellbores that extend from the parent wellbore. Quite often, a main parent casing string lines the parent wellbore; and liner string(s) hang from the parent casing string and extend from the parent wellbore into the lateral wellbore(s).

Conventionally, for purposes of creating a multi-lateral well, the parent wellbore is first drilled and then cased with a casing string. A particular lateral wellbore may then be established by first milling a window (called a "parent casing window") out of the wall of the parent casing string. The parent casing window forms the entry point of the lateral wellbore from the parent wellbore. After the lateral wellbore is drilled, a lateral liner string is run downhole so that the liner string hangs from the parent casing string and extends into the lateral wellbore. Depending on the particular multi-lateral system, the liner string may be cemented in place inside the parent casing string and/or may be sealed to the parent casing string.

It is often desirable to position the depth and orient the azimuth of the liner string with respect to the parent wellbore. For example, the liner string may have a window (called a "liner window") that needs to be positioned at the correct depth and properly oriented for purposes of, for example, permitting fluid communication between the central passageway of the liner string and the central passageway of the parent casing string. Furthermore, the liner window when properly positioned and oriented may be used to provide mechanical access to the parent wellbore beneath the liner string window. This access may be used for purposes of an intervention into this part of the parent wellbore.

Conventional systems to orient the liner string include features that are located on the parent casing window. However, many such systems have typically been somewhat unreliable.

Thus, there is a continuing need for better ways to orient a lateral string with respect to a parent wellbore.

SUMMARY

In an embodiment of the invention, a method that is usable with a subterranean well that has a first string that lines a borehole includes running a second string into the well and engaging a deflecting face on a deflector to deflect the second string through a window of the first string. The technique includes performing at least one of positioning the second string and orienting the second string using a profile on the deflector downhole of the deflecting face.

Advantages and other features of the invention will become apparent from the following description, drawing and claims.

DETAILED DESCRIPTION

Figure 1:
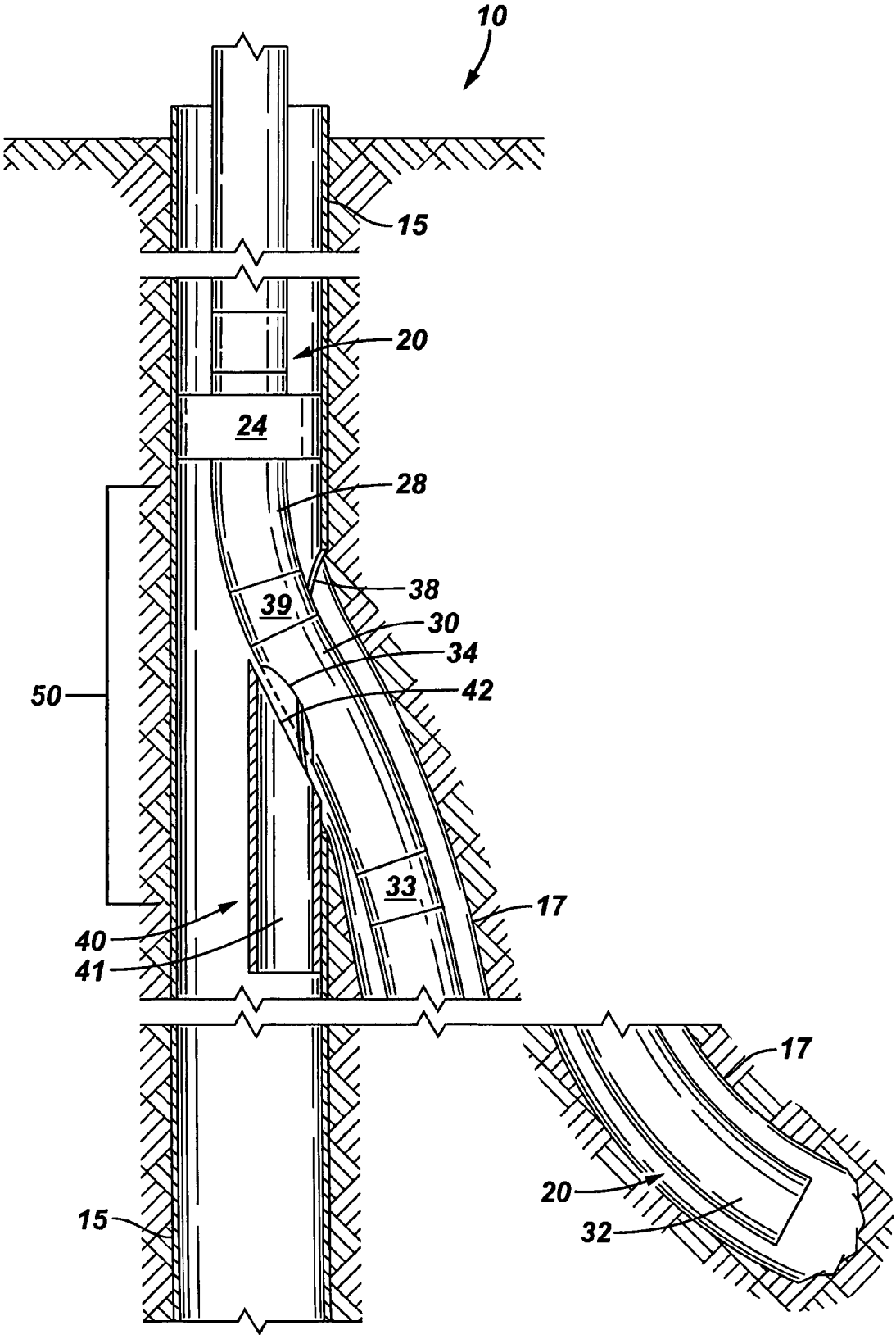
FIG. 1 is a schematic diagram of a subterranean well according to an embodiment of the invention.

Referring to FIG. 1, an embodiment 10 of a multi-lateral subterranean well in accordance with the invention includes a tubular string 20 that extends into a parent wellbore that is lined by a parent casing string 15. The string 20 includes a packer 24 (shown in the set position) from which hangs a tubular liner string 30. The liner string 30 extends through a milled casing window 38 of the parent casing string 15 and into a lateral wellbore 17 of the well 10.

It is noted that the well 10 that is depicted in FIG. 1 is simplified for clarifying the following description. Thus, the well 10 may have other and different features in other embodiments of the invention. For example, in other embodiments of the invention, a well may include multiple lateral wellbores and liner strings.

For purposes of routing the liner string 30 into the lateral wellbore 17, the well 10 includes a tubular, tubing string deflector (herein called the "deflector 40"), that is held in place generally concentric to the casing string 15 by means (an indexing casing coupler or a whipstock packer, as examples) known to those skilled in the art and is located beneath the casing window 38. The deflector 40 includes a generally inclined deflecting face 42 that is sloped at an angle with respect to the longitudinal axis of the parent wellbore to deflect the liner string 30 (that generally follows the longitudinal axis of the parent wellbore before contacting the deflecting face 42) into the lateral wellbore 17, as depicted in FIG. 1.

As also depicted in FIG. 1, in some embodiments of the invention, the liner string 30 includes a liner window 34, a window that is formed in the wall of the liner string 30 (before the liner string 30 is run downhole, for example) so that when position at the appropriate depth and properly oriented, the liner window 34 provides access (via a longitudinal passageway 41 of the deflector 40) to the portion of the parent wellbore located beneath the window 34. Thus, without the window 34, access to and fluid communication with the parent wellbore below the window 34 is prevented.

As further described below, in some embodiments of the invention, a profile is formed on the deflector 40 to ensure proper positioning of the liner string 30 (to the appropriate depth) and proper orientation of the liner string 30 (at the appropriate azimuth) so that 1.) the liner window 34 aligns with the portion of the parent wellbore beneath the window 34 (and also faces the passageway 41 of the deflector 40); and 2.) the liner window 34 is located above the passageway 41. This profile of the deflector 40 mates with a corresponding profile of the liner string 30 to, when the profiles engage, provide a positive indication (via a partial weight displacement of the string 20) at the surface of the proper depth and azimuth of the liner string 30 (and liner window 34).

Thus, as further described below, engagement of the two profiles is detectable at the surface of the well 10 to indicate that the liner string 30 is at the proper depth and azimuthal orientation. As a more specific example, in some embodiments of the invention, the deflector 40 includes a keyway profile that is constructed to receive a corresponding key profile of the liner string 30 when the liner string 30 has the appropriate depth and azimuthal orientation.

In some embodiments of the invention, the keyway profile of the deflector 40 is located below the deflecting face 42 so that when the deflector 40 is mounted to the inside of the casing string 15 (in a separate run into the well, for example), the casing window 38 exposes the keyway profile to the lateral wellbore 17. The keyway profile is designed to provide a tracking range to, for a predefined range of potential azimuthal positions of the liner string 30, rotate the liner string 30 into the proper final azimuthal position in which the liner window 34 is directed downhole and toward the opening of the passageway 41. For purposes of coarsely adjusting the azimuth of the liner string 30 so that the key profile of the string 30 is within this tracking range, the string 20 may include a gyro 39, in some embodiments of the invention.

For example, as depicted in FIG. 1 the gyro 39 may be located near the liner window 34 (in some embodiments of the invention) for purposes of providing feedback (via a telemetry path (not shown)) to the surface of the well 10 regarding the azimuth of the liner string 30. Therefore, by rotating the liner string 30 in accordance with the feedback that is provided by the gyro 39, the liner string 30 may be rotated to a position near its final proper azimuthal position, as the deflector's keyway profile (via its engagement with the key profile of the liner string 30) performs the fine rotational adjustment of the liner string 30 to place the liner string 30 at the final proper azimuthal position. At the conclusion of this fine rotational adjustment, the key and keyway profiles mate to offset at least some weight on the string 20 so that an operator at the surface of the well can detect the engagement. The packer 24 may then be set to hang the liner string 30, in some embodiments of the invention.

In other embodiments of the invention, the coarse azimuthal positioning of the liner string 30 is established by a trial and error tactic in that the liner string 30 may be incrementally rotated and then lowered to see if engagement between the key and keyway profiles occur (as indicated by the partial weight displacement of the string 20); and if not, the liner string 30 is pulled back uphole and rotated by another incremental adjustment. Therefore, this process is repeated until the partial weight displacement is detected at the surface of the well 10.

In some embodiments of the invention, to facilitate azimuthal orientation of the liner string 30, the liner string 30 includes a swivel clutch 33, a device that decouples rotation of an upper portion 28 of the liner string 30 from a lower portion 32 portion of the string 30. Thus, due to the clutch 33, the upper portion 28 of the liner string 30 may be rotated without rotating the lower portion 32 to facilitate azimuthal orientation of the liner string 30.

Figure 2:
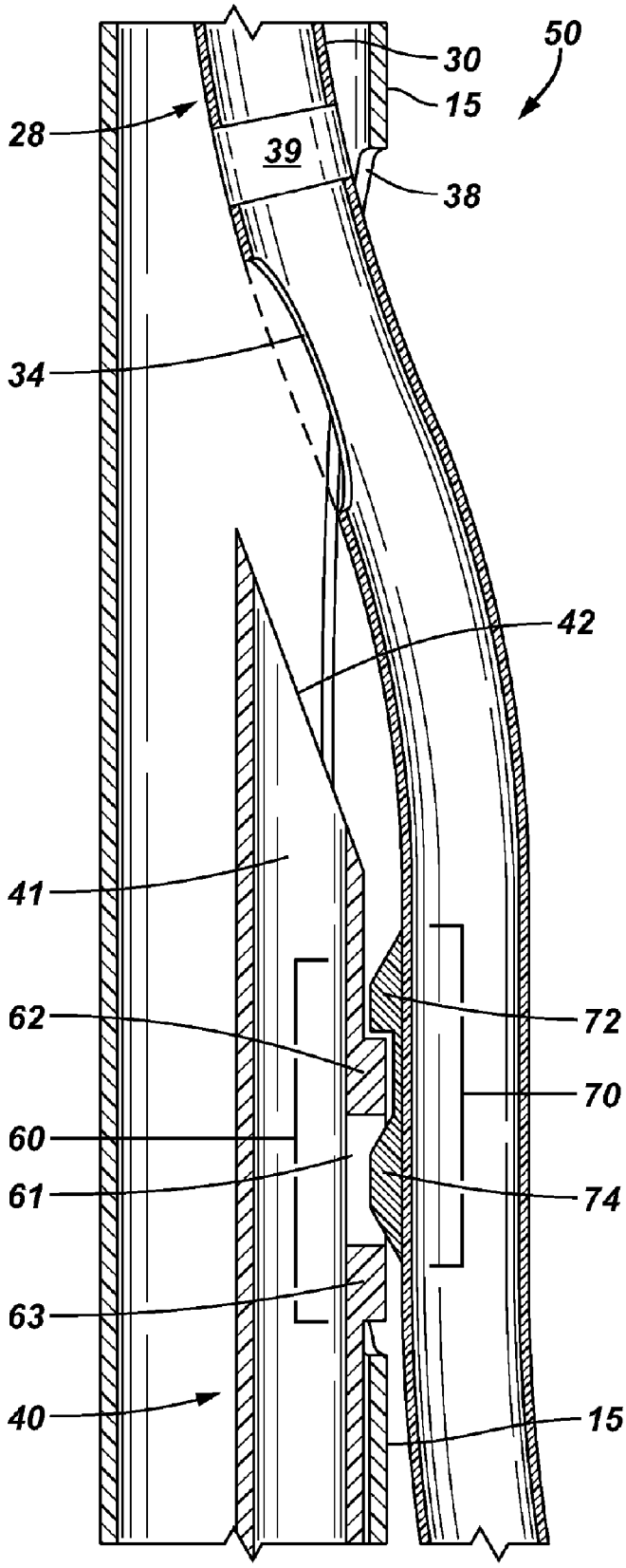
FIG. 2 is a more detailed view of a portion of the well of FIG. 1 according to an embodiment of the invention.

FIG. 2 depicts a more detailed section 50 (see FIG. 1) of the well 10. Referring to FIG. 2, as shown, in some embodiments of the invention, the deflector 40 includes a keyway profile 60 that is constructed to receive and mate with a corresponding key profile 70 of the liner string 30 when the liner string 30 is in its proper final azimuthal and depth positions. The keyway 60 and key 70 profiles may be switched, in other embodiments of the invention, so that the keyway profile 60 is located on the liner string 30, and the key profile 70 is located on the deflector 40. Thus, many variations are possible and are within the scope of the appended claims.

Although specific keyway 60 and key 70 profiles are depicted in FIG. 2, it is noted that these profiles are for purposes of example only to illustrate one out of many possible embodiments of the invention. For the embodiment that is depicted in FIG. 2, the keyway profile 60 includes a slot 61 that is constructed to receive a corresponding radial extension 74 of the key profile 70 when the profiles 60 and 70 mate. Furthermore, as depicted in FIG. 2, the keyway profile 60 may include a radial extension 62 that supports a corresponding radial extension 72 (of the key profile 70) that extends above the extension 62 when the profile 60 and 70 mate. The keyway profile 60 may include another radial extension 63 that extends below the radial extension 72 (of the key profile 70). The keyway 60 and key 70 profiles are also illustrated in a perspective view of the deflector 40 in FIG. 5.

Figure 3:
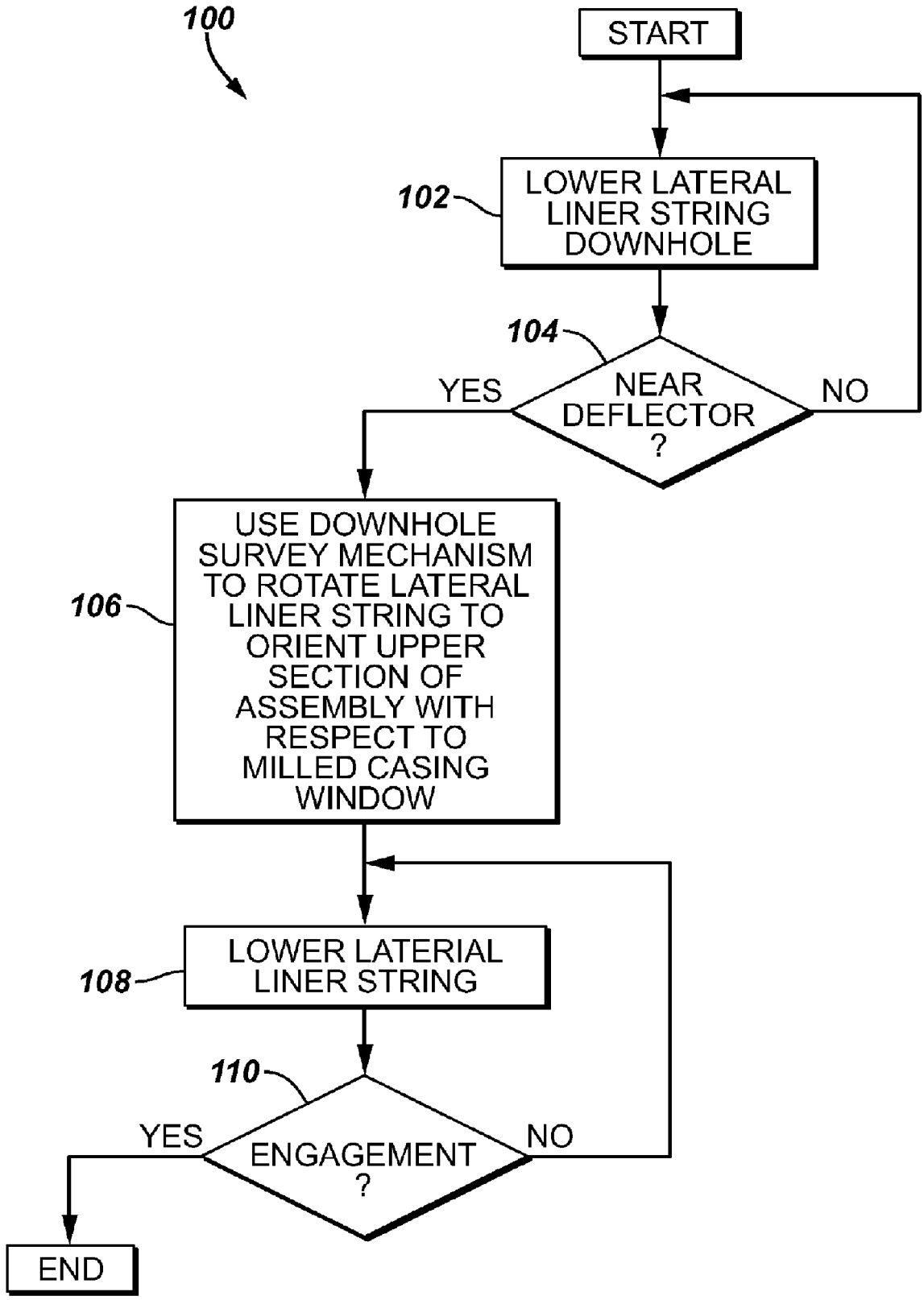
FIGS. 3 and 4 are flow diagrams depicting techniques to run a lateral liner string into a lateral wellbore according to different embodiments of the invention.

Referring to FIG. 3, in some embodiments of the invention, a technique 100 may be used to run a liner string, such as the liner string 30, downhole. Referring to FIG. 3, the technique 100 includes lowering (block 102) the liner string 30 downhole and determining (block 104) whether the liner string 30 is near the deflector 40. If not, then the lowering continues, as depicted in block 102.

When the liner string is near the deflector 40 (as indicated by the deployed length of the string 20, for example), then the technique 100 includes using a downhole survey mechanism (i.e., an azimuth orientation device) (such as the gyro 39 of FIG. 1) to rotate the liner string 30 to orient an upper section of the liner string 30 with respect to a milled casing window, as depicted in block 106. Therefore, referring to FIG. 1 in conjunction with FIG. 3, this rotation may include rotating the upper section 28 of the liner string 30 with respect to the lower section 32. The bifurcated rotation is permitted due to the swivel clutch 33. Referring to FIG. 3, after this rotation, the liner string 30 is lowered (block 108) and a determination is made (diamond 110) whether engagement between the mating profiles of the liner string 30 and deflector 40 have occurred. If so, then the technique 100 ends. Otherwise, the liner string continues to be lowered downhole pursuant to block 108.

Figure 4:
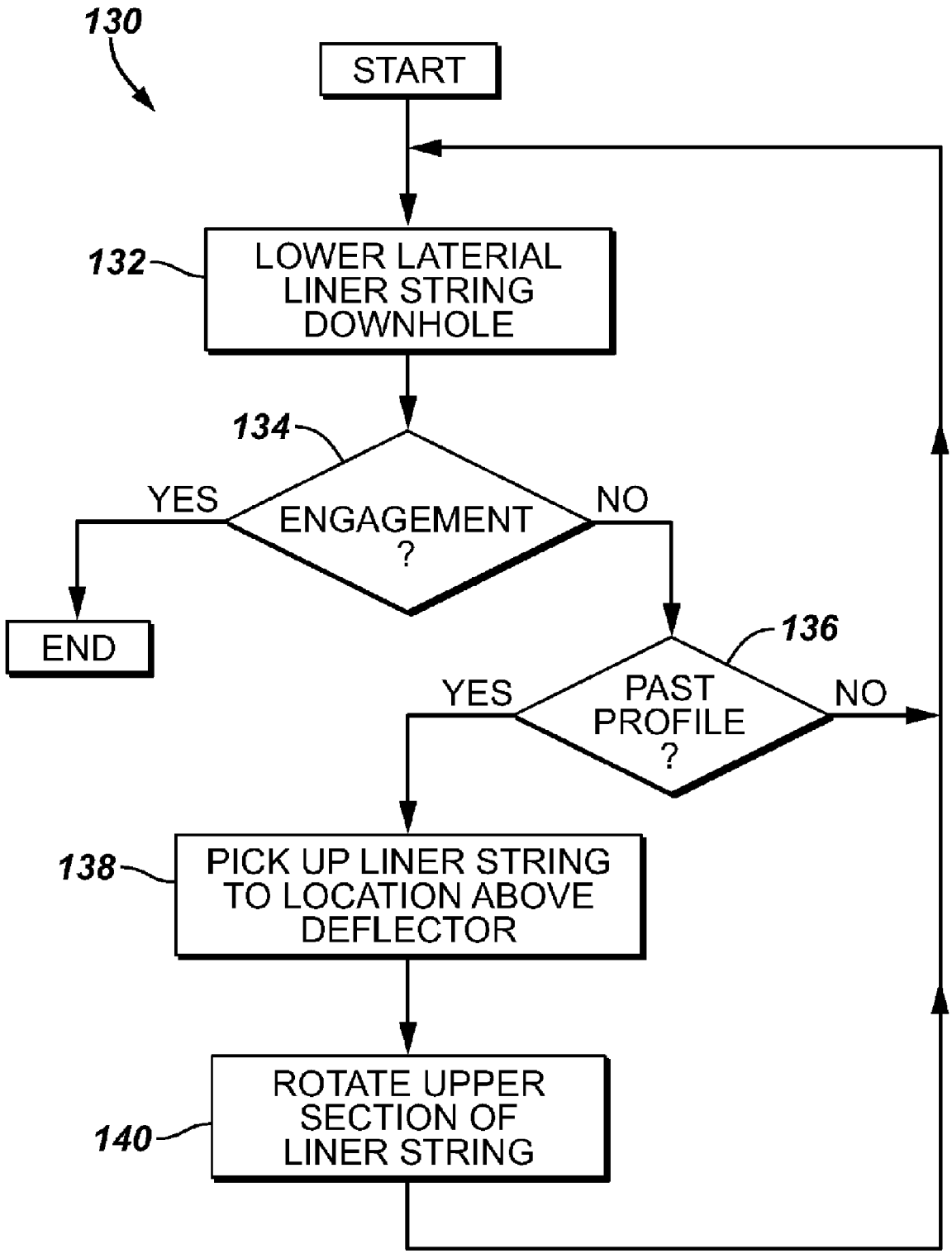

Alternatively, in some embodiments of the invention, the liner string 30 may not include an azimuth orientation device, such as a gyro. Instead, a trial and error technique may be used to orient the liner string 30 with respect to the parent borehole. More specifically, FIG. 4 depicts another technique 130 for running a liner string downhole. Referring to FIG. 4, pursuant to the technique 130, the liner string is lowered downhole (block 132) and a determination is made (diamond 134) whether engagement has occurred between the key and keyway profiles of the liner string and deflector. If so, then the technique 130 ends, as proper azimuthal orientation and depth positioning of the liner string has occurred. Otherwise, a determination is made (diamond 136) whether the key profile of the liner string is past the keyway profile of the deflector, as depicted in diamond 136. This may be determined by, for example, monitoring the length of the string that is used to position the liner string. If the liner string has not been lowered past the profile, then the liner string is continued to be run downhole, pursuant to block 132.

If the liner string has been run past the mating profile, then the liner string is picked up to a location above the deflector, as depicted in block 138. After this pickup, the upper section of the liner string is incrementally rotated (block 140) and the trial and error technique continues by lowering the liner string downhole pursuant to block 132. Eventually, the liner string has the proper azimuthal orientation and depth so that the key and keyway profiles engage, as indicated by partial weight displacement that is detectable at the surface of the well.

Figure 5:
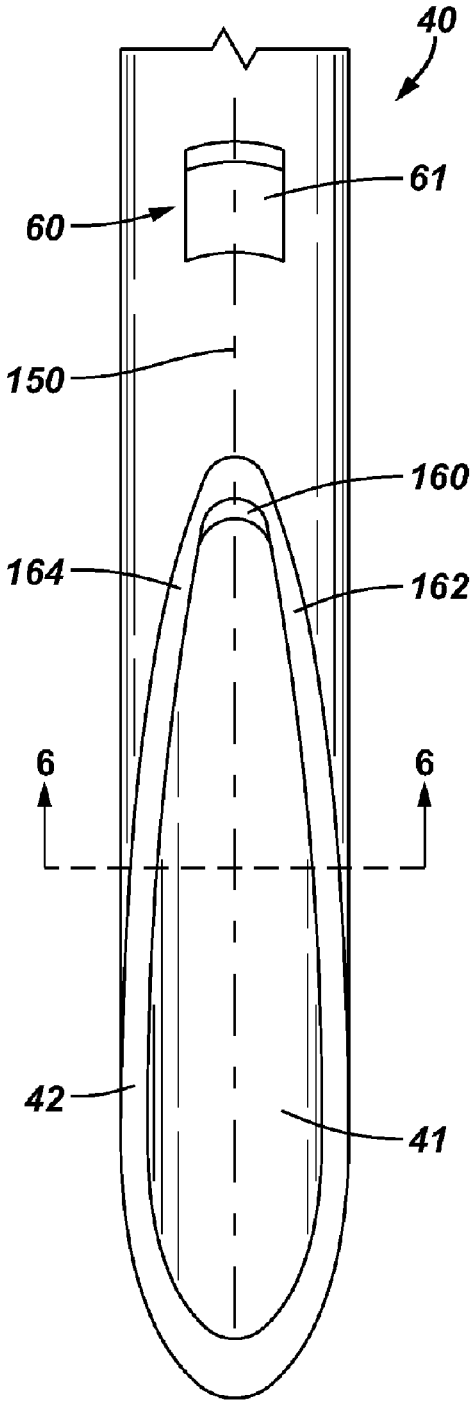
FIG. 5 is a top perspective view of the tubing deflector of FIGS. 1 and 2 according to an embodiment of the invention.
Figure 6:
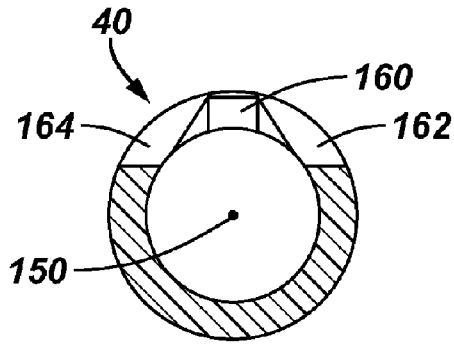
FIG. 6 is a cross-sectional view taken along line 6-6 of FIG. 5 according to an embodiment of the invention.

FIG. 5 depicts a top perspective view of the tubing deflector 40, in accordance with some embodiments of the invention. Referring to FIG. 5, in some embodiments of the invention, the deflector 40 may be hollow (and thus, include the longitudinal passageway 41), and the deflecting face 42 may present an approximate U-shaped channel along about its longitudinal axis to guide the key profile of the liner string toward a narrowed region 160 that coincides with a longitudinal axis 150 (of the deflector 40). The longitudinal axis 150, in turn, coincides with the keyway profile 60 of the deflector 40. Referring also to FIG. 6 (depicting a cross-section of the deflecting face 42 along line 6-6 of FIG. 5), in some embodiments of the invention, the deflecting face 42 may include surfaces 162 and 164 that may be generally level, as depicted in FIG. 6 at the uphole end of the deflecting force 42 and increasingly slanted toward the longitudinal axis 150 at the downhole end of the deflecting face 42. It is noted that in some embodiments of the invention, the surfaces 162 and 164 may not be inclined towards the longitudinal axis 150. The surfaces 162 and 164 follow the perimeter of the channel around the entry of the passageway 41 of the deflecting face 42 to meet at the longitudinal axis 150 (at narrowed region 160) to guide the key profile 70 (see FIG. 2) of the liner string 30 toward the keyway profile 60.

Figure 7:
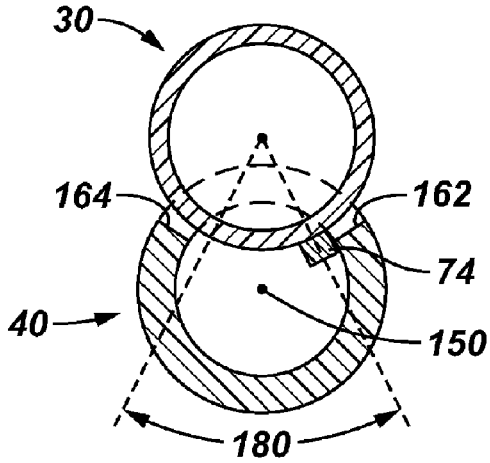
FIG. 7 is a cross-sectional view depicting initial engagement of the liner string with the tubing deflector according to an embodiment of the invention.

As a more specific example, FIG. 7 depicts the cross section of the deflector 40 shown in FIG. 6, along with a cross-sectional view of the liner string 30 during the initial engagement between the key profile 70 of the liner string 30 and the deflecting face 42 of the deflector 40. As depicted in FIG. 7, the radial extension 74 of the key profile 70 extends into the open groove of the face 42. As also depicted in FIG. 7, separation between the inclined faces 162 and 164 provides a tracking range 180 that permits capture of the key profile 70 over a predetermined azimuthal range and guidance of the key profile 70 toward the longitudinal axis 150 and into the keyway profile 60.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A method usable with a well, the well having a first string that lines a first borehole, the method comprising:

running a liner string into the well to line a lateral borehole that extends from the first borehole;

engaging a deflecting surface of a deflector to deflect the liner string into a window of the first string; and engaging a first profile of the liner string with a second profile on the deflector below the deflecting face to perform at least one of positioning the liner string and orienting the liner string.

2. The method of claim 1, wherein the second profile orients the liner string relative to the first borehole.

3. The method of claim 1, wherein the second profile on the deflector orients a window of the liner string with respect to the first borehole.

4. The method of claim 1, wherein the act of engaging the first profile on the liner string with the second profile on the deflector comprises:

engaging a key profile on one of the deflector and the liner string with a keyway profile on the other of the liner string and the deflector.

5. The method of claim 1, wherein the second profile orients an azimuthal position of the liner string.

6. The method of claim 1, wherein the second profile orients the liner string so that a window of the liner string is generally aligned with a passageway through the deflector.

7. The method of claim 1, wherein the second profile positions the liner string so that a liner window is at a predetermined location downhole.

8. The method of claim 1, wherein the act of performing comprises:

using a gyro to orient the liner string with respect to the profile;

subsequently lowering the liner string; and continue lowering the liner string to engage the profile.

9. The method of claim 1, further comprising:

using an offset of weight caused by the liner string engaging the second profile to indicate at least one of a proper orientation and a proper position of the liner string at the surface of the well.

10. The method of claim 1, wherein the act of performing comprises:

lowering the liner string downhole;

detecting whether the liner string has passed the second profile;

detecting whether the liner string has been engaged by the second profile;

in response to detecting whether the liner string has passed the second profile, raising the liner string and rotating the liner string; and in response to determining whether the liner string has been engaged by the second profile, determining that at least one of a proper orientation and a proper position of the liner string has occurred.

11. The method of claim 1, wherein the first string comprises a parent casing string.

12. An apparatus usable with a well having a first string comprising:

a liner string adapted to extend inside the first string through a window in the first string; and a first profile attached to the liner string and adapted to engage a second profile of a deflector located downhole of a deflecting face of the deflector to do at least one of orient the liner string and position the liner string.

13. The apparatus of claim 12, wherein the first profile orients a window in the liner string with respect to a borehole lined by the first string.

14. The apparatus of claim 12, wherein the first profile comprises a key profile, the second profile comprises a keyway profile and the key profile is adapted to engage the keyway profile.

15. The apparatus of claim 12, wherein the first profile is adapted to engage the second profile to place the liner string at a predetermined azimuthal position.

16. The apparatus of claim 12, wherein the first profile is adapted to engage the second profile to place a window of the liner string at a predetermined depth.

17. A tubing deflector usable with a well that includes a first string, the tubing deflector comprising:

a deflecting surface adapted to deflect a second string into a window of the first string; and a profile located below the deflecting surface and adapted to do at least one of orient the second string and position the second string, the profile being exposed by the window such that the profile is otherwise covered by a wall of the first string in the absence of the window.

18. The tubing deflector of claim 17, wherein the profile orients a window in the second string with a borehole lined by the first string.

19. The tubing deflector of claim 17, wherein the profile comprises a keyway profile to engage a key profile on the second string.

20. The tubing deflector of claim 17, wherein the profile comprises a guide to accept an azimuthal range of a mating profile of the second string and selectively rotate the second string to a predetermined azimuthal position.

21. The tubing deflector of claim 17, wherein the deflecting surface comprises a portion of a body of the deflector, the deflector further comprising a passageway that is adapted to align with a window in the second string.

22. The tubing deflector of claim 17, wherein the first string comprises a parent casing string and the second string comprises a liner string.

23. A system usable with a well, comprising:

a casing string having a window;

a liner string adapted to extend inside the casing string;

a first profile attached to the liner string; and a deflector comprising a deflecting face to deflect the liner string into the window of the casing string and comprising a second profile downhole of the deflecting face to mate with the first profile to do at least one of orient the liner string and position the liner string.

24. The system of claim 23, wherein the mating of the first profile and the second profile orients at least an azimuthal position of the liner string.

25. The system of claim 23, wherein the mating of the first profile and the second profile orients at least a window of the liner string with respect to a borehole lined by the casing string.

26. The system of claim 23, wherein the deflecting surface comprises a guide to accept a range of azimuthal positions to orient the liner string in a predetermined azimuthal position.

27. The system of claim 23, wherein the first profile and the second profile orient a window of the liner string with respect to a borehole lined by the casing string and located below the window of the second string.

28. The system of claim 23, wherein the first profile comprises a key profile, and the second profile comprises a keyway profile adapted to engage the key profile to orient the liner string.

29. A method usable with a well, comprising:

forming a first profile on a first string that is adapted to be deflected by a deflecting face of a deflector into a window of a second string, the forming including forming the first profile to engage a second profile of the deflector located downhole of the deflecting face to do at least one of orient and position the first string; and positioning the second profile such that the second profile is in closer alignment to a longitudinal axis of the second string than a path that follows the deflecting face of the deflector.

30. The method of claim 29, further comprising:

positioning the profile on the first string so that a window of the first string is oriented with respect to a borehole lined by the second string.

31. The method of claim 29, further comprising:

forming a key profile on the first string to engage a keyway profile of the deflector.

32. A method usable with a well, comprising:

forming a deflecting surface on a deflector to deflect a liner string into a window of a second string; and forming a first profile on the deflector downhole of the deflecting surface to engage a second profile of the liner string to orient the liner string.

33. The method of claim 32, further comprising:

positioning the first profile to orient a window of the liner string with respect to a borehole lined by the second string.

34. The method of claim 32, further comprising:

forming the first profile to be a keyway profile to engage the second profile.

35. The method of claim 32, further comprising:

forming a guide on the deflector to accept an azimuthal range and selectively rotate the liner string to a predetermined azimuthal position.

* * * * *